United States Patent [19]

Meaden et al.

[11] Patent Number: 4,916,764

[45] Date of Patent: Apr. 17, 1990

[54] BATHTUB SHOWER CURTAIN ASSEMBLY

[76] Inventors: Clive Meaden, 79 Arthur St., Holyoke, Mass. 01040; Christopher P. Dunn, 197 Celia Dr., Waterbury, Conn. 96705

[21] Appl. No.: 270,618

[22] Filed: Nov. 14, 1988

[51] Int. Cl.[4] ..... A47K 3/14

[52] U.S. Cl. ..... 4/558; 4/608; 160/23.1

[58] Field of Search ..... 4/608, 558, 610; 160/23.1, 26, 133, 271, DIG. 6

[56] References Cited

U.S. PATENT DOCUMENTS

| | | | |
|---|---|---|---|
| 1,732,798 | 10/1929 | Falzer | 4/558 |
| 2,481,397 | 9/1949 | Dalton, Jr. | 4/610 |
| 2,761,150 | 9/1956 | Kellogg | 4/558 |
| 2,840,827 | 7/1958 | Calvano | 4/558 |
| 3,050,742 | 8/1962 | Munson | 4/558 |
| 3,222,689 | 12/1965 | Efron et al. | 4/608 |

FOREIGN PATENT DOCUMENTS

| | | | |
|---|---|---|---|
| 6413924 | 6/1965 | Netherlands | 4/608 |

*Primary Examiner*—Henry J. Recla
*Assistant Examiner*—Edward C. Donovan
*Attorney, Agent, or Firm*—Leon Gilden

[57] ABSTRACT

A bathtub shower curtain assembly includes a supporting frame structure designed to replace conventional shower door or curtain constructions associated with a bathtub. One end of the frame structure includes a vertically positioned case in which a rolled, retractable shower curtain is mounted, while a leading edge of the curtain extends outwardly from the case with a handle being attached to a midportion of the extending edge. Top and bottom edges of the curtain are retained in guide tracks forming a part of the supporting structure, so that the curtain may be drawn across the bathtub to form an enclosure in the manner of a conventional shower curtain. When not in use, the shower curtain may be retracted into the case in a manner similar to a window shade, while wipers are provided on opposite sides of the case opening to remove water and dirt from the curtain during its retraction.

1 Claim, 1 Drawing Sheet

BATHTUB SHOWER CURTAIN ASSEMBLY

BACKGROUND OF THE INVENTION

1. Field of the Invention

The present invention relates generally to bathtub enclosures, and is more particularly concerned with a protective enclosure of the curtain type for bathtub installations having a shower head associated therewith.

2. Description of the Prior Art

As is well known in the prior art, bathtub and shower enclosures most generally consist of two types of construction. One of the more common types comprises foldable or slidable panel structures which utilize top and bottom guide channels. These types of enclosures are bulky, unsightly, difficult to clean and highly visible. Further, they are expensive to procure inasmuch as special construction is necessitated in order to accommodate top and bottom guide channels, while these channels also create safety hazzards.

The other most well known conventional type of bathtub enclosure utilizes a shower curtain supported from an overhead rod. In this construction, again the curtain can not be concealed from view and, while comparatively inexpensive to manufacture and install, this latter structure is substantially inefficient due to its failure to prevent water from leaking about the edges thereof.

There has been some attempts to vary from these basic, conventional constructions in an effort to improve the appearance, convenience and water tight integrity of such enclosures. One such attempt is to be found in U.S. Pat. No. 2,761,150, which issued to Kellogg on Sept. 4, 1956, wherein a collapsible shower curtain mounted in tracks is disclosed. While the Kellogg assembly utilizes a flexible curtain, an expensive track system is employed to prevent the curtain from flapping when the shower is in use. A review of this patent clearly illustrates the complexity of the included track system which most likely accounts for the fact that the Kellogg device is not presently available in the commercial market.

Another attempt to improve the efficiency and appearance of bathtub enclosures is to be found in U.S. Pat. No. 3,050,742, which issued to Munson on Aug. 28, 1962. The Munson device utilizes a flexible curtain assembly which is foldable in an accordian-like manner into concealment within a housing when not in use. When a use thereof is desired, the curtain may be pulled outwardly from the housing across the tub enclosure and fastened to a remotely positioned fastener. However, the Munson device utilizes no guiding track system and depends instead upon the semi-rigid structure of the curtain to prevent flapping and consequent water leakage.

At least one attempt has been made to design an efficient flexible shower curtain which, when not in use, may be retained on a roller within a recessed area proximate a bathtub. In this respect, reference is made to U.S. Pat. No. 1,732,798, which issued to Falzer on Oct. 22, 1929. While the shower curtain of Falzer may be wound on a roller when not in use, the complete design of this invention involves an enclosure built into a wall proximate the bathtub into which the curtain roller must be positioned, and further necessitates the use of a pivotally mounted, telescoping curtain rod which would normally also be retained within the wall opening when the shower curtain is not being used. To effect the usage of this device, it is necessary to remove the supporting curtain rod and extend it into a supporting position along a horizontal wall surface before the shower curtain per se can be unwound. Once unwound, the flexible curtain must be attached to the extended support rod, and must be further retained in place by attachment to the opposite wall through the use of conventional fasteners. No track system is employed in this patent however, whereby flapping of the curtain will result during a use of the shower, and this of course permits excessive water leakage. Further, the design of the invention necessitates a specially shaped shower curtain which would facilitate its positioning over the edge of a bathtub so as to extend downwardly thereinto.

Accordingly, it can be appreciated that there is a continuing need for new and improved bathtub enclosures which improve the convenience, appearance and water tight integrity of a combined bathtub and shower, while at the same time being of an inexpensive and reliable construction, and in this respect, the present invention substantially fulfills this need.

SUMMARY OF THE INVENTION

In view of the foregoing disadvantages inherent in the known types of bathtub and shower enclosures now present in the prior art, the present invention provides an improved flexible and inexpensive shower curtain assembly wherein the same can be retracted into a concealing case when not in use. As such, the general purpose of the present invention, which will be described subsequently in greater detail, is to provide a new and improved bathtub shower curtain assembly which has all of the advantages of the prior art bathtub shower curtain assemblies and none of the disadvantages. To attain this, the present invention comprises a substantially rectangular frame supporting structure mountable along a topmost edge of a bathtub. The supporting frame structure replaces the conventional door tracks associated with sliding shower doors, and has a vertically positioned retaining case positioned along one edge thereof. A spring-biased curtain roller is retained within the case, while the case may be mounted to a wall to increase the structural rigidity of the entire assembly.

The flexible shower curtain retained upon the curtain roller may be pulled from the case to extend completely across the length of the tub, thereby to form a water tight enclosure, with top and bottommost edges of the flexible curtain being guided in specially designed guide tracks forming a part of the supporting frame. A further feature of the invention includes wipers mounted on the curtain retaining case, with such wipers serving to remove water from the curtain during a retraction thereof into the case. There has thus been outlined, rather broadly, the more important features of the present invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions so far as they do not depart from the spirit and scope of the present invention.

It is therefore an object of the present invention to provide a new and improved bathtub shower curtain assembly which has all of the advantages of the prior art bathtub shower curtain assemblies and none of the disadvantages.

It it another object of the present invention to provide a new and improved bathtub shower curtain assembly which may be easily and efficiently manufactured and marketed.

It is a further object of the present invention to provide a new and improved bathtub shower curtain assembly which is of a durable and reliable construction, and which may be efficiently and reliably assembled for use.

Still another object of the present invention is to provide a new and improved bathtub shower curtain assembly which is convenient to use and which provides for a neat appearance thereof.

Yet another object of the present invention is to provide a new and improved bathtub shower curtain assembly which is easy to clean and assemble, and which provides for substantial water tight integrity.

Still yet another object of the present invention is to provide a new and improved bathtub shower curtain assembly which is characterized by a portable and lightweight construction, whereby the same can be conveniently transported, stored and assembled.

An even further object of the present invention is to provide a new and improved bathtub shower curtain assembly which is susceptible of a low cost to manufacture with regard to both materials and labor, and which accordingly is then susceptible of low prices of sale to the consuming public, thereby making such shower curtain assemblies economically available to the buying public.

Still yet another object of the present invention is to provide a new and improved bathtub shower curtain assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 2:
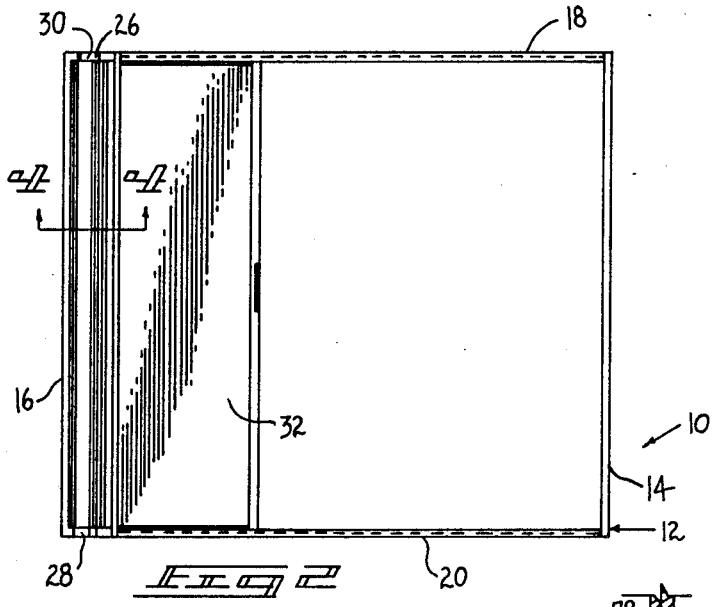
FIG. 2 is a front elevation view of the present invention.
Figure 1:
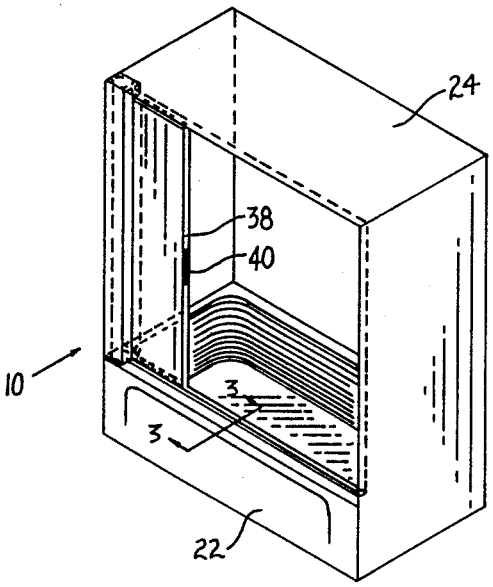
FIG. 1 is a perspective view of the bathtub shower curtain assembly comprising the present invention showing the assembly operably mounted on a bathtub.

With reference now to the drawings and in particular to FIGS. 1 and 2 thereof, a new and improved bathtub shower curtain assembly embodying the principles and concepts of the present invention and generally designated by the reference numeral 10 will be described. In this respect, it can be seen that the assembly 10 includes a substantially rectangular frame structure 12 essentially comprising a vertical side track 14 and a vertical case 16 attached together by top and bottom located guide tracks 18, 20 respectively. As best illustrated in FIG. 1, the bathtub shower curtain assembly 10 may be selectively attached to a conventional bathtub 22 having a premolded surrounding enclosure 24. Of course, it is to be understood that the surrounding enclosure 24 could also effectively comprise existing walls and ceilings in a building structure and as such, any such type of surrounding enclosure is within the intent and scope of the present invention.

With further reference to FIGS. 1 and 2, it will be noted that the case 16 is desirably of a hollow construction and includes mounts 26, 28 for receiving the ends of a spring-biased roller rod 30. Operably rolled about the rod 30 is a flexible vinyl shower curtain 32, with it now being apparent that the curtain may be pulled across the length of the bathtub 22 to effectively enclose the same during a use of the associated shower. While the shower curtain 32 has been described as being of a flexible vinyl construction, it is to be understood that any conceivable material which would perform the desired function of the present invention is within the intent and purview of this disclosure and accompanying claims.

Figure 3:
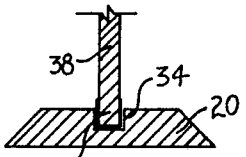
FIG. 3 is a cross-section view of the invention viewed along the lines 3—3 in FIG. 1.

FIG. 3 illustrates a first embodiment of the shower guide track 20 as aforementioned. In this respect, it can be seen that the guide track 20 is of a trapezoidal shape and includes an intermediately positioned, axially aligned trough 34. The guide track 20, which is substantially similiar to the construction of the guide track 18, may be mounted to a supporting surface, which in this case would be a topmost edge of the bathtub 22, by any conventional means. Such means desirably includes adhesives, especially silicone adhesives which are substantially waterproof however, with respect to the attachment of the complete frame structure to walls and ceilings surrounding the bathtub 22, both silicone adhesives and threaded fasteners might be employed, although it is to be understood that any type of conventional fastening means is within the scope of the present invention. Additionally, the guide track 20, as well as the track 18, may be constructed of a flexible polymeric material to enhance its adjustable positioning and attachment to a supporting surface.

FIG. 3 also shows a rigid support bar 38 which extends between the flexible tracks 18, 20 and is retained within the respective troughs 34. As is apparent from FIG. 1, the shower curtain 32 is fixably secured to the bar 38, with such bar having a handle 40 and serving as the means by which the flexible curtain is withdrawn from the case 16 when desired. By the same token, the bar 38 is of a sufficient diameter to prevent its movement through the slot 42, as shown in FIG. 4, into the case 16 during a retraction of the curtain 32.

Figure 4:
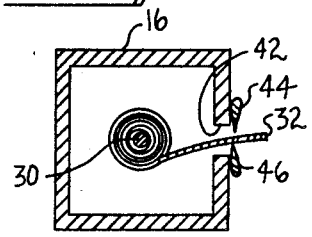
FIG. 4 is a cross-sectional view of the invention viewed along the lines 4—4 in FIG. 2.

With continuing reference to FIG. 4 of the drawings, it will be noted that the longitudinal slot 42 which extends along the entire axial length of the case 16, may include oppositely disposed, paralleledly aligned wipers 44, 46. The wipers 44, 46 are of a flexible polymeric construction and flexibly engage the opposed surfaces of the flexible curtain 32 during its extension from and retraction into the case 16. The wipers 44, 46 serve to clean the curtain 32 during such extensions and retractions, and to further remove excess water therefrom on the shower side of the curtain during a retraction operation. As such, the wipers 44, 46 serve to maintain the shower curtain 32 in a clean condition and in a aesthetically pleasing appearance at all times.

FIG. 4 further illustrates the support rod 30 about which the flexible shower curtain 32 is wound, with it being understood that a conventional springwinding mechanism may be utilized to effect the curtain rolling operation when desired. Of course, the unillustrated spring should be of a rust proof construction and further, it is desirable that only a slight spring biasing tension be maintained so that the shower curtain 32 does not retract of its own accord. More desirably, a user of the curtain should have to apply a slight hand pressure to the curtain 32 to effect the desired retraction thereof into the case 16. FIG. 4 also illustrates the fact that a front wall portion 48 of the case 16 is of a removable construction, thereby to facilitate ingress to the case when it is desired to replace or repair the curtain 32 or its supporting rod 30.

Figure 5:
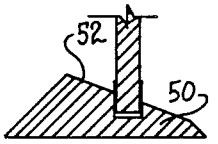
FIG. 5 is a modified embodiment of the shower curtain guide track wherein such embodiment would be viewed along the lines 3—3 in FIG. 1.

Inasmuch as water may collect upon and travel across the flexible guide track 20 as shown in FIG. 3, a modified embodiment thereof is illustrated in FIG. 5 which is generally designated by the reference numeral 50. In this construction, it can be seen that the topmost surface 52 of the guide track 50 is sloped downwardly toward an interior portion of the bathtub 22, thereby to facilitate water drainage into the tub during a use of the associated shower. This construction then facilitates the water tight integrity of the invention 10 by directing the excess water back into the shower stall.

With respect of the manner of use of the present invention, it can be appreciated that after the bathtub shower curtain assembly 10 has been mounted in the manner illustrated in FIG. 1, a user thereof need only to grasp the handle 40 and pull the shower curtain 32 outwardly from the case 16 across the topmost edge of the bathtub. Inasmuch as the top and bottom edges of the shower curtain 32 are retained within the respective troughs 34 forming a part of the guide tracks 18, 20, a complete and watertight enclosing of the user within the shower stall is accomplished. After taking a shower, a user need only to regrasp the handle 40 and with a slight hand pressure, the shower curtain 32 will be retracted into the case 16 about the roller 30, with the wipers 44, 46 effecting a desired cleaning and water removal action.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bathtub shower curtain assembly, in combination with a bathtub, comprising:

frame support means including shower curtain guide track means; the curtain guide track means including a lower track secured to a topmost surface of said bathtub and an upper track spaced above and parallel to the lower track, and a flexible shower curtain means including upper and lower ends of a guide rod slidably movable and receivable within respective upper and lower troughs in said upper and lower tracks;

shower curtain retraction means; and a casing means orthogonally and fixedly mounted between opposed and aligned ends of said upper and lower tracks, and wherein said frame support means is of a substantially rectangular construction, and wherein said shower curtain retraction means includes roller means of a spring biased construction about which said flexible shower curtain means may be selectively rolled, and further including slot means positioned within said casing means, with said flexible shower curtain means being movable through said slot means during a rolling thereof about said roller means, and further including flexible elongate polymeric wiper means positioned coextensively along said slot means said wiper means mounted for engaging opposed sides of said flexible shower curtain means during a movement thereof through a slot means, and wherein said guide track means includes a downwardly-sloped topmost surface, thereby to facilitate water drainage from said flexible shower curtain onto said topmost surface of said guide track means and thence downwardly into an interior portion of said bathtub.

* * * * *